US011692158B2

(12) United States Patent
Meier et al.

(10) Patent No.: US 11,692,158 B2
(45) **Date of Patent: *Jul. 4, 2023**

(54) WASHING AGENT WITH IMPROVED OPTICAL AND RHEOLOGICAL PROPERTIES

(71) Applicant: Henkel AG & Co. KGaA, Duesseldorf (DE)

(72) Inventors: Frank Meier, Duesseldorf (DE); Peter Schmiedel, Duesseldorf (DE); Daniel Thomas Piorkowski, Fairfield, CT (US); Kathrin Schnepp-Hentrich, Monheim (DE); Berthold Schreck, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 228 days.

This patent is subject to a terminal disclaimer.

(21) Appl. No.: 16/937,325

(22) Filed: Jul. 23, 2020

(65) Prior Publication Data

US 2022/0025306 A1 Jan. 27, 2022

(51) Int. Cl.

| | |
|---|---|
| ***C11D 17/04*** | (2006.01) |
| ***C11D 1/22*** | (2006.01) |
| ***C11D 1/722*** | (2006.01) |
| ***C11D 1/83*** | (2006.01) |
| ***C11D 3/04*** | (2006.01) |
| ***C11D 3/20*** | (2006.01) |
| ***C11D 3/40*** | (2006.01) |
| ***C11D 11/00*** | (2006.01) |

(52) U.S. Cl.

CPC ..... *C11D 17/045* (2013.01); *C11D 1/22* (2013.01); *C11D 1/722* (2013.01); *C11D 1/8305* (2013.01); *C11D 3/046* (2013.01); *C11D 3/2013* (2013.01); *C11D 3/2034* (2013.01); *C11D 3/2044* (2013.01); *C11D 3/2079* (2013.01); *C11D 3/40* (2013.01); *C11D 11/0017* (2013.01); *C11D 17/043* (2013.01)

(58) Field of Classification Search

CPC ..... C11D 17/045; C11D 1/22; C11D 1/722

See application file for complete search history.

(56) References Cited

U.S. PATENT DOCUMENTS

| | | | | |
|---|---|---|---|---|
| 3,658,552 | A * | 4/1972 | Carlson | A23L 2/62 106/205.71 |
| 6,855,680 | B2 * | 2/2005 | Smerznak | C11D 1/72 510/340 |
| 8,901,062 | B2 * | 12/2014 | De Meirleir | C11D 17/0017 510/432 |
| 9,023,786 | B2 * | 5/2015 | Schmiedel | C11D 3/046 510/504 |
| 9,187,714 | B2 * | 11/2015 | Schmiedel | C11D 1/652 |
| 2010/0041577 | A1 * | 2/2010 | Tippetts | C11D 3/2068 510/303 |
| 2010/0305020 | A1 * | 12/2010 | Jennewein | C11D 3/3765 510/513 |
| 2015/0275154 | A1 * | 10/2015 | Souter | C11D 17/045 510/296 |
| 2016/0319226 | A1 * | 11/2016 | Lant | C11D 3/38636 |
| 2017/0029747 | A1 * | 2/2017 | Depoot | C11D 17/043 |
| 2017/0226447 | A1 * | 8/2017 | Keuleers | C11D 3/2068 |
| 2022/0025306 | A1 * | 1/2022 | Meier | C11D 3/2013 |

FOREIGN PATENT DOCUMENTS

| | | | |
|---|---|---|---|
| EP | 0922754 | A1 | 6/1999 |
| EP | 3124585 | A1 | 2/2017 |
| EP | 3202879 | A1 | 8/2017 |
| EP | 3517596 | A1 | 7/2019 |
| WO | 2010141301 | A1 | 12/2010 |
| WO | 2015148763 | A1 | 10/2015 |
| WO | 2016176280 | A1 | 11/2016 |

OTHER PUBLICATIONS

"Microplastic-Free, Opacified Liquid Laundry Detergents" U.S. Appl. No. 62/938,707 Piorkowski, Daniel Thomas et al., filed Nov. 21, 2019.

International Search Report Application No. PCT/EP2021/067514 dated Sep. 20, 2021 Mailed: Oct. 7, 2021 15 Pages.

* cited by examiner

*Primary Examiner* — Nicole M. Buie-Hatcher
*Assistant Examiner* — M. Reza Asdjodi
(74) *Attorney, Agent, or Firm* — Bojuan Deng

(57) ABSTRACT

A washing agent portion unit including a) at least one first receiving chamber, b) at least one water-soluble film surrounding this first receiving chamber, and c) at least one first flowable washing agent preparation located in the first receiving chamber, which preparation contains, based on the total weight thereof, i) 40 to 80 wt. % surfactant; ii) 2 to 15 wt. % fatty acid; iii) 0.3 to 8 wt. % of salt of a divalent cation; iv) 8 to 35 wt. % solvent; d) at least one second receiving chamber which is surrounded by a water-soluble film and is filled with a second washing agent preparation which differs from the first flowable washing agent preparation, wherein the first receiving chamber and the second receiving chamber are directly adjacent to one another and separated from one another by a water-soluble film, and washing methods using these washing agent portion units.

20 Claims, No Drawings

WASHING AGENT WITH IMPROVED OPTICAL AND RHEOLOGICAL PROPERTIES

FIELD OF THE INVENTION

The present invention relates to washing agent portion units comprising a flowable washing agent preparation and methods for washing textiles using these washing agent portion units. In particular, this application relates to washing agent portion units which contain surfactant and salt and are packaged in multi-chamber portion pouches.

BACKGROUND OF THE INVENTION

The commercial success of a washing agent is of course also determined, in addition to processing-related aspects, by the ability to provide a product that meets consumer interests. An essential means of communicating product quality and product claims is the appearance of the product, including the shape and color of the washing agent. This applies to the liquid or solid washing agents themselves, and also to water-soluble film pouches, the soluble films of which are generally transparent and give a clear view of the solid or liquid washing agents contained. While colored, i.e. non-white, liquid washing agents can be obtained in a simple manner by adding appropriate dyes, the provision of white liquid washing agents is more challenging because the opacifying agents previously used for their production are increasingly being critically assessed from an ecological point of view. Against this background, the provision of an ecologically acceptable opacifying agent is a relevant development objective in the field of liquid washing and cleaning agents.

As described above, white liquid washing agents are used, for example, in water-soluble film pouches, in which said washing agents can be combined with other liquid or solid washing agents. The provision of a pouch design which is attractive from a consumer perspective and technically easy to produce is another important development objective.

BRIEF SUMMARY OF THE INVENTION

In summary, the problem addressed by the application was that of providing visually appealing, concentrated washing agent portion units which can be produced in a simple and efficient manner.

The present invention firstly relates to a washing agent portion unit comprising a) at least one first receiving chamber,
b) at least one water-soluble film surrounding this first receiving chamber, and
c) at least one first flowable washing agent preparation located in the first receiving chamber, which preparation contains, based on the total weight thereof,
i) 40 to 80 wt. % surfactant;
ii) 2 to 15 wt. % fatty acid;
iii) 0.3 to 8 wt. % of salt of a divalent cation;
iv) 8 to 35 wt. % solvent;
d) at least one second receiving chamber which is surrounded by a water-soluble film and is filled with a second washing agent preparation which differs from the first flowable washing agent preparation, wherein the first receiving chamber and the second receiving chamber are directly adjacent to one another and separated from one another by a water-soluble film.

The first washing agent preparation is flowable under standard conditions (20° C., 1013 mbar).

DETAILED DESCRIPTION OF THE INVENTION

A first essential component of the first washing agent preparation is the surfactant, which is contained in the washing agent preparation in an amount of 20 to 80 wt. %, preferably 30 to 75 wt. % and in particular 40 to 70 wt. %.

The group of surfactants include the non-ionic, anionic, cationic and amphoteric surfactants. The group of surfactants also includes the co-surfactants described below. The compositions according to the invention can comprise one or more of the surfactants mentioned. Particularly preferred compositions contain at least one anionic surfactant as the surfactant.

The anionic surfactant is preferably selected from the group comprising $C_9$-$C_{13}$ alkylbenzene sulfonates, olefin sulfonates, $C_{12}$-$C_{18}$ alkane sulfonates, ester sulfonates, alk(en)yl sulfates, fatty alcohol ether sulfates and mixtures thereof. Compositions which comprise $C_9$-$C_{13}$ alkylbenzene sulfonates and fatty alcohol ether sulfates as the anionic surfactant have particularly good dispersing properties. Surfactants of the sulfonate type that can be used are preferably $C_9$-$C_{13}$ alkylbenzene sulfonates, olefin sulfonates, i.e. mixtures of alkene and hydroxyalkane sulfonates, and disulfonates, as obtained, for example, from $C_{12}$-$C_{18}$ monoolefins having a terminal or internal double bond by way of sulfonation with gaseous sulfur trioxide and subsequent alkaline or acid hydrolysis of the sulfonation products. $C_{12}$-$C_{18}$ alkane sulfonates and the esters of α-sulfofatty acids (ester sulfonates) are also suitable, for example the α-sulfonated methyl esters of hydrogenated coconut, palm kernel or tallow fatty acids.

The alkali salts and in particular the sodium salts of the sulfuric acid half-esters of $C_{12}$-$C_{18}$ fatty alcohols, for example from coconut fatty alcohol, tallow fatty alcohol, lauryl alcohol, myristyl alcohol, cetyl alcohol or stearyl alcohol, or of $C_{10}$-$C_{20}$ oxo alcohols and the half-esters of secondary alcohols having these chain lengths are preferred as alk(en)yl sulfates. From a washing perspective, $C_{12}$-$C_{16}$ alkyl sulfates, $C_{12}$-$C_{15}$ alkyl sulfates and $C_{14}$-$C_{15}$ alkyl sulfates are preferred. 2,3-alkyl sulfates are also suitable anionic surfactants.

The salts of the sulfuric acid half-esters of fatty alcohols having 12 to 18 C atoms, for example from coconut fatty alcohol, tallow fatty alcohol, lauryl alcohol, myristyl alcohol, cetyl alcohol or stearyl alcohol, or of the oxo alcohols having 10 to 20 C atoms and the half-esters of secondary alcohols having these chain lengths are preferred as alk(en)yl sulfates. From a washing perspective, the alkyl sulfates having 12 to 16 C atoms, alkyl sulfates having 12 to 15 C atoms and alkyl sulfates having 14 and 15 C atoms are preferred. 2,3-alkyl sulfates are also suitable anionic surfactants.

Fatty alcohol ether sulfates, such as the sulfuric acid monoesters of straight-chain or branched $C_7$-$C_{21}$ alcohols ethoxylated with 1 to 6 mol ethylene oxide, such as 2-methyl-branched C9-11 alcohols having, on average, 3.5 mol ethylene oxide (EO) or C12-18 fatty alcohols having 1 to 4 EO, are also suitable. Alkyl ether sulfates of formula (A-1) are preferred:

$$R^1\text{—O-(AO)}_n\text{—SO}_3^-X^+ \qquad \text{(A-1)}$$

In this formula (A-1), $R^1$ represents a linear or branched, substituted or unsubstituted alkyl functional group, preferably a linear, unsubstituted alkyl functional group, particularly preferably a fatty alcohol functional group. Preferred functional groups $R^1$ of formula (A-1) are selected from decyl, undecyl, dodecyl, tridecyl, tetradecyl, pentadecyl, hexadecyl, heptadecyl, octadecyl, nonadecyl, eicosyl functional groups and mixtures thereof, the representatives having an even number of C atoms being preferred. Particularly preferred functional groups $R^1$ of formula (A-1) are derived from fatty alcohols having 12 to 18 C atoms, for example from coconut fatty alcohol, tallow fatty alcohol, lauryl alcohol, myristyl alcohol, cetyl alcohol or stearyl alcohol, or from oxo alcohols having 10 to 20 C atoms.

In formula (A-1), AO represents an ethylene oxide (EO) or propylene oxide (PO) group, preferably an ethylene oxide group. The index n in formula (A-1) is an integer of from 1 to 50, preferably from 1 to 20, and in particular from 2 to 10. Very particularly preferably, n is 2, 3, 4, 5, 6, 7 or 8. X is a monovalent cation or the n-th part of an n-valent cation, the alkali metal ions, including $Na^+$ or $K^+$, being preferred in this case, with $Na^+$ being most preferred. Further cations $X^+$ may be selected from $NH_4^+$, ½ $Zn^{2+}$, ½ $Mg^{2+}$, ½ $Ca^{2+}$, ½ $Mn^{2+}$, and mixtures thereof.

Particularly preferred compositions contain an alkyl ether sulfate selected from fatty alcohol ether sulfates of formula A-2

(A-2)

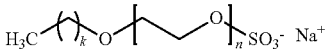

where k=11 to 19, and n=2, 3, 4, 5, 6, 7 or 8. Very particularly preferred representatives are Na fatty alcohol ether sulfates having 12 to 18 C atoms and 2 EO (k=11 to 13, n=2 in formula A-1). The degree of ethoxylation indicated represents a statistical average that can correspond to an integer or a fractional number for a specific product. The degrees of alkoxylation indicated represent statistical averages that can correspond to an integer or a fractional number for a specific product. Preferred alkoxylates/ethoxylates have a narrowed homolog distribution (narrow range ethoxylates, NRE).

In a particularly preferred embodiment, the composition contains $C_{9-13}$ alkylbenzene sulfonates and optionally also fatty alcohol ether sulfates as the anionic surfactant.

It is very particularly preferred for the composition to contain at least one anionic surfactant of formula (A-3)

(A-3)

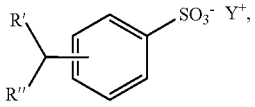

in which

R' and R" are, independently of one another, H or alkyl, and together contain 9 to 19, preferably 9 to 15 and in particular 9 to 13, C atoms, and $Y^+$ denotes a monovalent cation or the n-th part of an n-valent cation (in particular NO.

In summary, preferred washing agent preparations contain, as the surfactant, at least one anionic surfactant, preferably at least one anionic surfactant from the group consisting of $C_{8-18}$ alkylbenzene sulfonates, $C_{8-18}$ olefin sulfonates, $C_{12-18}$ alkane sulfonates, $C_{8-18}$ ester sulfonates, $C_{8-18}$ alkyl sulfates, $C_{8-18}$ alkenyl sulfates, fatty alcohol ether sulfates, in particular at least one anionic surfactant from the group of $C_{8-18}$ alkylbenzene sulfonates.

The proportion by weight of the anionic surfactant with respect to the total weight of the flowable washing agent preparation is preferably 20 to 60 wt. % and in particular 25 to 50 wt. %.

In addition to the surfactant described above, the flowable washing agent preparation contains fatty acid as a second essential component. For the optical properties, the viscosity profile and the cleaning performance of the preparation, it has proven advantageous for the flowable washing agent preparation to contain, based on the total weight thereof, 4 to 12 wt. %, preferably 6 to 10 wt. %, of fatty acid.

Preferred fatty acids are selected from the group of caprylic acid, capric acid, lauric acid, myristic acid, palmitic acid, stearic acid, oleic acid, linoleic acid and mixtures thereof.

As a third essential component, the flowable washing agent preparation contains the salt of a divalent cation. The proportion by weight of this salt with respect to the total weight of the first flowable washing agent preparation is preferably 0.4 to 6 wt. % and in particular 0.5 to 4 wt. %. These proportions by weight have proven to be advantageous in terms of both the appearance and the viscosity of the preparation.

Because of their availability, magnesium or calcium salts are particularly preferably used, the salt of a divalent cation being particularly preferably selected from the group of the salts of divalent metal cations, in particular of magnesium and calcium salts, preferably from the group of magnesium chloride, magnesium sulfate, calcium chloride and calcium sulfate.

Preferred salts have a solubility in water (20° C.) above 400 g/l. The use of salts from the group of magnesium chloride and calcium chloride is very particularly preferred.

The washing agent preparation contains a solvent as a fourth essential component. The proportion by weight of the solvent with respect to the total weight of the first flowable washing agent preparation is preferably 12 to 32 wt. % and in particular 15 to 30 wt. %. With regard to processability, it has proven to be advantageous for the flowable washing agent preparation to contain, based on the total weight thereof, 7 to 20 wt. %, preferably 10 to 18 wt. %, of organic solvent.

Preferred organic solvents are selected from the group of ethanol, n-propanol, propanol, butanols, glycol, propanediol, butanediol, methylpropanediol, glycerol, diglycol, propyl diglycol, butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl ether, propylene glycol ethyl ether, propylene glycol propyl ether, dipropylene glycol mono methyl ether, dipropylene glycol mono ethyl ether, methoxytriglycol, ethoxytriglycol, butoxytriglycol, 1-butoxyethoxy-2-propanol, 3-methyl-3-methoxybutanol, propylene-glycol-t-butylether, di-n-octylether and mixtures thereof, preferably from the group of propanediol, glycerol and mixtures thereof.

The first washing agent preparation is preferably a low-water substance mixture. Flowable washing agent preparations of this kind which contain, based on the total weight thereof, less than 18 wt. %, preferably less than 15 wt. %, of water are preferred.

In summary, washing agent portion units are preferred which comprise flowable washing agent preparations which contain, based on the total weight thereof, i) 20 to 80 wt. % surfactant including 20 to 50 wt. % anionic surfactant;

ii) 4 to 12 wt. % fatty acid;

iii) 0.5 to 4 wt. % of the salt of a divalent metal cation;

iv) 8 to 35 wt. % solvent.

The composition of some preferred first flowable washing agent preparations can be derived from the following tables (amounts given in wt. % based on the total weight of the preparation, unless otherwise indicated).

| | Formula 1 | Formula 2 | Formula 3 | Formula 4 |
|---|---|---|---|---|
| Surfactant | 20 to 80 | 30 to 75 | 30 to 75 | 40 to 70 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Solvent | 8 to 35 | 12 to 32 | 12 to 32 | 15 to 30 |
| Misc. | to make up to 100 | to make up to 100 | to make up to 100 | to make up to 100 |

| | Formula 6 | Formula 7 | Formula 8 | Formula 9 |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Solvent | 8 to 35 | 12 to 32 | 12 to 32 | 15 to 30 |
| Misc. | to make up to 100 | to make up to 100 | to make up to 100 | to make up to 100 |

| | Formula 11 | Formula 12 | Formula 13 | Formula 14 |
|---|---|---|---|---|
| Surfactant | 20 to 80 | 30 to 75 | 30 to 75 | 40 to 70 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Solvent | 8 to 35 | 12 to 32 | 12 to 32 | 15 to 30 |
| Misc. | to make up to 100 | to make up to 100 | to make up to 100 | to make up to 100 |

| | Formula 16 | Formula 17 | Formula 18 | Formula 19 |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Solvent | 8 to 35 | 12 to 32 | 12 to 32 | 15 to 30 |
| Misc. | to make up to 100 | to make up to 100 | to make up to 100 | to make up to 100 |

| | Formula 21 | Formula 22 | Formula 23 | Formula 24 |
|---|---|---|---|---|
| Surfactant | 20 to 80 | 30 to 75 | 30 to 75 | 40 to 70 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 26 | Formula 27 | Formula 28 | Formula 29 |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 31 | Formula 32 | Formula 33 | Formula 34 |
|---|---|---|---|---|
| Surfactant | 20 to 80 | 30 to 75 | 30 to 75 | 40 to 70 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 36 | Formula 37 | Formula 38 | Formula 39 |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

* preferably $C_{8-18}$ alkylbenzene sulfonates

In a technically advantageous variant, the first flowable washing agent preparation also contains, based on the total weight thereof, v) 0.5 to 4 wt. %, preferably 0.5 to 3 wt. % and in particular 0.5 to 2 wt. %, of the salt of a monovalent cation.

By adding the monovalent cation, the cloudy-white appearance of the washing agent preparation is enhanced. At the same time, the resulting compositions are distinguished by optimal viscosity properties. In particular, the addition of the monovalent cation in large proportions by weight causes sufficient turbidity without increasing the viscosity of the washing agent preparation in a manner which makes it difficult to convey said preparation in pipe systems and dose said preparation. Finally, the addition of the salt of a monovalent cation reduces the temperature dependence of the viscosity of the flowable washing agent preparation and thus simplifies the processing thereof.

The use of monovalent metal salts, in particular the use of sodium chloride, also improves the storage stability, in particular the storage stability in the event of temperature fluctuations.

Preferred monovalent cations are selected from the group of monovalent metal cations. Because of their availability and low costs, preferred salts of monovalent cations are selected from the group of sodium chloride, potassium chloride, sodium sulfate, sodium carbonate, potassium sulfate, potassium carbonate, sodium hydrogen carbonate, potassium hydrogen carbonate, very preferably from the group of sodium chloride.

In summary, a second particularly preferred embodiment is characterized in that the washing agent portion unit comprises a first flowable washing agent preparation which contains, based on the total weight thereof, i) 20 to 80 wt. % surfactant including 20 to 50 wt. % anionic surfactant;

ii) 4 to 12 wt. % fatty acid;

iii) 0.5 to 4 wt. % of the salt of a divalent metal cation;

iv) 8 to 35 wt. % solvent;

v) 0.5 to 4 wt. % of the salt of a monovalent metal cation.

The composition of some further particularly preferred flowable washing agent preparations can be derived from the following tables (amounts given in wt. % based on the total weight of the preparation, unless otherwise indicated).

| | Formula 1a | Formula 2a | Formula 3a | Formula 4a |
|---|---|---|---|---|
| Surfactant | 20 to 80 | 30 to 75 | 30 to 75 | 40 to 70 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Salt of a monovalent cation | 0.5 to 4 | 0.5 to 3 | 0.5 to 3 | 0.5 to 2 |
| Solvent | 8 to 35 | 12 to 32 | 12 to 32 | 15 to 30 |
| Misc. | to make up to 100 | to make up to 100 | to make up to 100 | to make up to 100 |

| | Formula 6a | Formula 7a | Formula 8a | Formula 9a |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Salt of a monovalent cation | 0.5 to 4 | 0.5 to 3 | 0.5 to 3 | 0.5 to 2 |
| Solvent | 8 to 35 | 12 to 32 | 12 to 32 | 15 to 30 |
| Misc. | to make up to 100 | to make up to 100 | to make up to 100 | to make up to 100 |

| | Formula 11a | Formula 12a | Formula 13a | Formula 14a |
|---|---|---|---|---|
| Surfactant | 20 to 80 | 30 to 75 | 30 to 75 | 40 to 70 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Salt of a monovalent cation | 0.5 to 4 | 0.5 to 3 | 0.5 to 3 | 0.5 to 2 |
| Solvent | 8 to 35 | 12 to 32 | 12 to 32 | 15 to 30 |
| Misc. | to make up to 100 | to make up to 100 | to make up to 100 | to make up to 100 |

| | Formula 16a | Formula 17a | Formula 18a | Formula 19a |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Salt of a monovalent cation | 0.5 to 4 | 0.5 to 3 | 0.5 to 3 | 0.5 to 2 |
| Solvent | 8 to 35 | 12 to 32 | 12 to 32 | 15 to 30 |
| Misc. | to make up to 100 | to make up to 100 | to make up to 100 | to make up to 100 |

| | Formula 21a | Formula 22a | Formula 23a | Formula 24a |
|---|---|---|---|---|
| Surfactant | 20 to 60 | 20 to 60 | 20 to 50 | 20 to 50 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Sodium chloride | 0.5 to 4 | 0.5 to 3 | 0.5 to 3 | 0.5 to 2 |
| Solvent | 8 to 35 | 12 to 32 | 12 to 32 | 15 to 30 |
| Misc. | to make up to 100 | to make up to 100 | to make up to 100 | to make up to 100 |

| | Formula 26a | Formula 27a | Formula 28a | Formula 29a |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Sodium chloride | 0.5 to 4 | 0.5 to 3 | 0.5 to 3 | 0.5 to 2 |
| Solvent | 8 to 35 | 12 to 32 | 12 to 32 | 15 to 30 |
| Misc. | to make up to 100 | to make up to 100 | to make up to 100 | to make up to 100 |

| | Formula 31a | Formula 32a | Formula 33a | Formula 34a |
|---|---|---|---|---|
| Surfactant | 20 to 60 | 20 to 60 | 20 to 50 | 20 to 50 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Sodium chloride | 0.5 to 4 | 0.5 to 3 | 0.5 to 3 | 0.5 to 2 |
| Solvent | 8 to 35 | 12 to 32 | 12 to 32 | 15 to 30 |
| Misc. | to make up to 100 | to make up to 100 | to make up to 100 | to make up to 100 |

| | Formula 36a | Formula 37a | Formula 38a | Formula 39a |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Sodium chloride | 0.5 to 4 | 0.5 to 3 | 0.5 to 3 | 0.5 to 2 |
| Solvent | 8 to 35 | 12 to 32 | 12 to 32 | 15 to 30 |
| Misc. | to make up to 100 | to make up to 100 | to make up to 100 | to make up to 100 |

| | Formula 41a | Formula 42a | Formula 43a | Formula 44a |
|---|---|---|---|---|
| Surfactant | 20 to 80 | 30 to 75 | 30 to 75 | 40 to 70 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Salt of a monovalent cation | 0.5 to 4 | 0.5 to 3 | 0.5 to 3 | 0.5 to 2 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 46a | Formula 47a | Formula 48a | Formula 49a |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Salt of a monovalent cation | 0.5 to 4 | 0.5 to 3 | 0.5 to 3 | 0.5 to 2 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 51a | Formula 52a | Formula 53a | Formula 54a |
|---|---|---|---|---|
| Surfactant | 20 to 80 | 30 to 75 | 30 to 75 | 40 to 70 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Sodium chloride | 0.5 to 4 | 0.5 to 3 | 0.5 to 3 | 0.5 to 2 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 56a | Formula 57a | Formula 58a | Formula 59a |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Sodium chloride | 0.5 to 4 | 0.5 to 3 | 0.5 to 3 | 0.5 to 2 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

* preferably $C_{8-18}$ alkylbenzene sulfonates

In a further technically advantageous variant, the flowable washing agent preparation contains, based on the total weight thereof, 12 to 30 wt. %, preferably 15 to 25 wt. %, of non-ionic surfactant and particularly preferably also 0.3 to 5 wt. % of a non-ionic co-surfactant that differs from the non-ionic surfactant.

Preferred non-ionic surfactants are selected from the group of alkoxylated primary $C_{8-18}$ alcohols having a degree of alkoxylation of ≥4, particularly preferably the $C_{12-14}$ alcohols having 4 EO or 7 EO, the $C_{9-11}$ alcohols having 7 EO, the $C_{13-15}$ alcohols having 5 EO, 7 EO or 8 EO, the $C_{13-15}$ oxo alcohols having 7 EO, the $C_{12-18}$ alcohols having 5 EO or 7 EO, the $C_{13-15}$ oxo alcohols having 7 EO, in particular the primary $C_{12-18}$ alcohols having a degree of alkoxylation of 4, very particularly preferably the primary $C_{12-18}$ alcohols having 7 EO.

With regard to the rheological properties of the first flowable washing agent preparation and the processability thereof, it has proven to be advantageous to use anionic surfactant and non-ionic surfactant in a weight ratio of from 3:1 to 1:2, preferably from 2:1 to 1:1.5 and in particular from 1.4:1 to 1:1.

It has proven to be technically advantageous to supplement the previously described surfactant system consisting of anionic and non-ionic surfactant with a further co-surfactant. The proportion by weight of the co-surfactant with respect to the total weight of the first flowable washing agent preparation is preferably 0.3 to 5 wt. %. In the context of this application, the co-surfactants are not included in the surfactants described further above. Preferred co-surfactants are selected from the group consisting of alkoxylated primary $C_8$-$C_{18}$ alcohols having a degree of alkoxylation of ≤3, aliphatic $C_6$-$C_{14}$ alcohols, aromatic $C_6$-$C_{14}$ alcohols, aliphatic $C_6$-$C_{12}$ dialcohols, monoglycerides of $C_{12}$-$C_{18}$ fatty acids, monoglycerol ethers of $C_8$-$C_{18}$ fatty alcohols, in particular from the group of alkoxylated primary $C_{12}$-$C_{18}$ alcohols having a degree of alkoxylation of ≤3.

In summary, a third particularly preferred embodiment is characterized in that the washing agent portion unit comprises a first flowable washing agent preparation which contains, based on the total weight thereof, i) 32 to 80 wt. % surfactant including 20 to 50 wt. % anionic surfactant and 12 to 30 wt. % non-ionic surfactant;
ii) 4 to 12 wt. % fatty acid;
iii) 0.5 to 4 wt. % of the salt of a divalent cation;
iv) 8 to 35 wt. % solvent;
v) 0.3 to 5 wt. % of a co-surfactant that differs from the non-ionic surfactant and is selected from the group of alkoxylated primary $C_8$-$C_{18}$ alcohols having a degree of alkoxylation of ≤3, aliphatic $C_6$-$C_{14}$ alcohols, aromatic $C_6$-$C_{14}$ alcohols, aliphatic $C_6$-$C_{12}$ dialcohols, monoglycerides of $C_{12}$-$C_{18}$ fatty acids, monoglycerol ethers of $C_8$-$C_{18}$ fatty alcohols, in particular from the group of alkoxylated primary $C_{12}$-$C_{18}$ alcohols having a degree of alkoxylation of ≤3.

The composition of some further particularly preferred first flowable washing agent preparations can be derived from the following tables (amounts given in wt. % based on the total weight of the cleaning agent, unless otherwise indicated).

| | Formula 1b | Formula 2b | Formula 3b | Formula 4b |
|---|---|---|---|---|
| Total surfactant | 32.3 to 80 | 32.3 to 75 | 35.5 to 75 | 40 to 70 |
| Anionic surfactant * | 20 to 60 | 20 to 60 | 20 to 50 | 20 to 50 |
| Non-ionic surfactant | 12 to 30 | 12 to 30 | 15 to 25 | 15 to 25 |
| Co-surfactant ** | 0.3 to 5 | 0.3 to 5 | 0.5 to 4 | 0.5 to 4 |

-continued

| | Formula 1b | Formula 2b | Formula 3b | Formula 4b |
|---|---|---|---|---|
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Solvent | 8 to 35 | 12 to 32 | 12 to 32 | 15 to 30 |
| Misc. | to make up to 100 | to make up to 100 | to make up to 100 | to make up to 100 |

10

| | Formula 6b | Formula 7b | Formula 8b | Formula 9b |
|---|---|---|---|---|
| Total surfactant | 32.3 to 80 | 32.3 to 75 | 35.5 to 75 | 40 to 70 |
| Anionic surfactant * | 20 to 60 | 20 to 60 | 20 to 50 | 20 to 50 |
| Non-ionic surfactant | 12 to 30 | 12 to 30 | 15 to 25 | 15 to 25 |
| Co-surfactant ** | 0.3 to 5 | 0.3 to 5 | 0.5 to 4 | 0.5 to 4 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Solvent | 8 to 35 | 12 to 32 | 12 to 32 | 15 to 30 |
| Misc. | to make up to 100 | to make up to 100 | to make up to 100 | to make up to 100 |

| | Formula 11b | Formula 12b | Formula 13b | Formula 14b |
|---|---|---|---|---|
| Total surfactant | 32.3 to 80 | 32.3 to 75 | 35.5 to 75 | 40 to 70 |
| Anionic surfactant * | 20 to 60 | 20 to 60 | 20 to 50 | 20 to 50 |
| Non-ionic surfactant | 12 to 30 | 12 to 30 | 15 to 25 | 15 to 25 |
| Co-surfactant ** | 0.3 to 5 | 0.3 to 5 | 0.5 to 4 | 0.5 to 4 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 16b | Formula 17b | Formula 18b | Formula 19b |
|---|---|---|---|---|
| Total surfactant | 32.3 to 80 | 32.3 to 75 | 35.5 to 75 | 40 to 70 |
| Anionic surfactant * | 20 to 60 | 20 to 60 | 20 to 50 | 20 to 50 |
| Non-ionic surfactant | 12 to 30 | 12 to 30 | 15 to 25 | 15 to 25 |
| Co-surfactant ** | 0.3 to 5 | 0.3 to 5 | 0.5 to 4 | 0.5 to 4 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 21b | Formula 22b | Formula 23b | Formula 24b |
|---|---|---|---|---|
| Total surfactant | 32.3 to 80 | 32.3 to 75 | 35.5 to 75 | 40 to 70 |
| Anionic surfactant * | 20 to 60 | 20 to 60 | 20 to 50 | 20 to 50 |
| Non-ionic surfactant *** | 12 to 30 | 12 to 30 | 15 to 25 | 15 to 25 |
| Co-surfactant **** | 0.3 to 5 | 0.3 to 5 | 0.5 to 4 | 0.5 to 4 |
| Fatty acid | 2 to 15 | 4 to 12 | 4 to 12 | 6 to 10 |

-continued

| | Formula 21b | Formula 22b | Formula 23b | Formula 24b |
|---|---|---|---|---|
| Salt of a divalent cation | 0.3 to 8 | 0.3 to 8 | 0.4 to 6 | 0.5 to 4 |
| Solvent | 8 to 35 | 12 to 32 | 12 to 32 | 15 to 30 |
| Misc. | to make up to 100 | to make up to 100 | to make up to 100 | to make up to 100 |

| | Formula 26b | Formula 27b | Formula 28b | Formula 29b |
|---|---|---|---|---|
| Total surfactant | 32.3 to 80 | 32.3 to 75 | 35.5 to 75 | 40 to 70 |
| Anionic surfactant * | 20 to 60 | 20 to 60 | 20 to 50 | 20 to 50 |
| Non-ionic surfactant *** | 12 to 30 | 12 to 30 | 15 to 25 | 15 to 25 |
| Co-surfactant **** | 0.3 to 5 | 0.3 to 5 | 0.5 to 4 | 0.5 to 4 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Solvent | 8 to 35 | 12 to 32 | 12 to 32 | 15 to 30 |
| Misc. | to make up to 100 | to make up to 100 | to make up to 100 | to make up to 100 |

| | Formula 31b | Formula 32b | Formula 33b | Formula 34b |
|---|---|---|---|---|
| Total surfactant | 32.3 to 80 | 32.3 to 75 | 35.5 to 75 | 40 to 70 |
| Anionic surfactant * | 20 to 60 | 20 to 60 | 20 to 50 | 20 to 50 |
| Non-ionic surfactant *** | 12 to 30 | 12 to 30 | 15 to 25 | 15 to 25 |
| Co-surfactant **** | 0.3 to 5 | 0.3 to 5 | 0.5 to 4 | 0.5 to 4 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 36b | Formula 37b | Formula 38b | Formula 39b |
|---|---|---|---|---|
| Total surfactant | 32.3 to 80 | 32.3 to 75 | 35.5 to 75 | 40 to 70 |
| Anionic surfactant * | 20 to 60 | 20 to 60 | 20 to 50 | 20 to 50 |
| Non-ionic surfactant *** | 12 to 30 | 12 to 30 | 15 to 25 | 15 to 25 |
| Co-surfactant **** | 0.3 to 5 | 0.3 to 5 | 0.5 to 4 | 0.5 to 4 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

55

| | Formula 41b | Formula 42b | Formula 43b | Formula 44b |
|---|---|---|---|---|
| Total surfactant | 32.3 to 80 | 32.3 to 75 | 35.5 to 75 | 40 to 70 |
| $C_{8-18}$ alkylbenzene sulfonate | 20 to 60 | 20 to 60 | 20 to 50 | 20 to 50 |
| Primary $C_{12-18}$ alcohols with 7 EO | 12 to 30 | 12 to 30 | 15 to 25 | 15 to 25 |
| $C_{13}$ alcohols with 2 EO or 3 EO | 0.3 to 5 | 0.3 to 5 | 0.5 to 4 | 0.5 to 4 |
| Fatty acid | 2 to 15 | 4 to 12 | 4 to 12 | 6 to 10 |

-continued

| | Formula 41b | Formula 42b | Formula 43b | Formula 44b |
|---|---|---|---|---|
| Magnesium chloride, calcium chloride | 0.3 to 8 | 0.3 to 8 | 0.4 to 6 | 0.5 to 4 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

* preferably $C_{8-18}$ alkylbenzene sulfonates

** co-surfactant which differs from the non-ionic surfactant and is selected from the group consisting of alkoxylated primary $C_8$-$C_{18}$ alcohols having a degree of alkoxylation of ≤3, aliphatic $C_6$-$C_{14}$ alcohols, aromatic $C_6$-$C_{14}$ alcohols, aliphatic $C_6$-$C_{12}$ dialcohols, monoglycerides of $C_{12}$-$C_{18}$ fatty acids, monoglycerol ethers of $C_8$-$C_{18}$ fatty alcohols, in particular from the group of alkoxylated primary $C_{12}$-$C_{18}$ alcohols having a degree of alkoxylation of ≤3

*** primary $C_{12-18}$ alcohols having a degree of alkoxylation of ≥4, preferably primary $C_{12-18}$ alcohols having 7 EO

**** alkoxylated primary $C_{12}$-$C_{18}$ alcohols having a degree of alkoxylation of ≤3, preferably $C_{13}$ alcohols having 2 EO or 3 EO The flowable washing agent preparation preferably has a viscosity (21° C., Brookfield viscometer type DV-II Pro, spindle no. 2, 20 rpm) above 400 mPas, preferably above 1000 mPas.

The flowable washing agent preparation is preferably designed in the form of a structured system. The main types of structured system used in practice are based on dispersed lamellar, spherulitic and attenuated lamellar phases. The flowable washing agent preparation preferably contains a spherulitic phase. Spherulitic phases comprise spherical bodies, commonly referred to in the art as spherulites, in which surfactant bilayers are arranged as concentric shells. The spherulites are dispersed in an aqueous phase in the manner of a classic emulsion, and interact to form a structured system. Preferred flowable washing agent preparations comprise lamellar spherulites, preferably having a maximum diameter of from 10 to 100 μm, particularly preferably having a maximum diameter of from 25 to 50 μm.

The flowable washing agent preparation preferably has a yield point (TA Instruments rotation rheometer AR 2000, 20° C., cone plate with 40 mm diameter, 2° cone angle) above 0.1 Pa, preferably above 0.3 Pa.

The rheological properties of the first flowable washing agent preparation justify its efficient processability and also form the basis of its advantageous optical properties, including its cloudy white appearance.

The Nephelometric Turbidity Unit (NTU) is frequently used as an indication of transparency. It is a unit, used e.g. in water treatment, for measuring turbidity e.g. in liquids. It is a unit of turbidity measured using a calibrated nephelometer. High NTU values are measured for clouded compositions, whereas low values are determined for clear compositions.

The HACH Turbidimeter 2100Q from Hach Company, Loveland, Colo. (USA) is used with the calibration substances StabICal Solution HACH (20 NTU), StabICal Solution HACH (100 NTU) and StabICal Solution HACH (800 NTU), all of which can also be produced by Hach Company. The measurement is filled with the composition to be analyzed in a 10 ml measuring cuvette having a cap and is carried out at 20° C.

At an NTU value (at 20° C.) of 60 or more, shaped bodies have a perceptible turbidity within the meaning of the invention, as can be seen with the naked eye. The turbidity (HACH Turbidimeter 2100Q, 20° C., 10 ml cuvette) of the liquid, surfactant-containing washing agent is preferably above 60 NTU, particularly preferably above 100 NTU and in particular above 400 NTU.

The flowable washing agent preparation is preferably free from organic opacifying agents. "Free from," as used in this context, means that the corresponding constituent is present in the preparation in an amount of <1 wt. %, preferably <0.1 wt. %, more preferably <0.01 wt. %. In particular, a constituent of this kind is not deliberately added. The flowable washing agent preparations preferably contain in particular no styrene-acrylate copolymers (INCI: styrene/acrylates copolymer).

The flowable washing agent preparation can be free from enzymes and/or fragrances. These constituents are in particular not contained because they can adversely affect the turbidity and thus the appearance of the formulation.

For example, flowable washing agent preparations which contain, based on the total weight thereof, less than 2 wt. %, preferably less than 1 wt. %, particularly preferably less than 0.1 wt. % and in particular no enzyme preparation are preferred.

Flowable washing agent preparations which contain, based on the total weight thereof, less than 2 wt. %, preferably less than 1 wt. %, particularly preferably less than 0.1 wt. % and in particular no fragrance are also preferred.

In an alternative embodiment, the flowable washing agent preparation contains at least one optical brightener, preferably a stilbene-type optical brightener. This is contained in the flowable washing agent preparation, based on the total weight thereof, in an amount above 0 wt. %, but preferably in an amount below 1 wt. %, particularly preferably in an amount below 0.6 wt. %. Stilbene-type brighteners for use in the flowable washing agent preparation are preferably selected from the group of triazinyl derivatives of 4,4'-diamino-2,2'-stilbenesulfonic acid. The economically most important stilbene derivatives are DAS1 (di sodium 4,4-bis[(4-anilino-6-morpholino-1,3,5-triazin-2-yl)amino]stilbene-2,2-di sulfonate) and DSBP (di sodium 4,4-bis(2-sulfostyryl)biphenyl).

Alternatively or additionally, the flowable washing agent preparation can comprise at least one blue or violet dye. This is contained in the flowable washing agent preparation, based on the total weight thereof, in an amount above 0 wt. %, but preferably in an amount below 0.1 wt. %, particularly preferably below 0.02 wt. %, for example between 0.001 and 0.01 wt. %. A dye of this kind is used, for example, for the purpose of masking a possible yellowish hue in the preparation.

In addition to the first flowable washing agent preparation described above, the washing agent portion units according to the invention comprise at least one further washing agent preparation which differs from the first flowable washing agent preparation. This further washing agent preparation can be flowable or solid and can be present in the form of a powder or granules, for example. It is preferred to combine the first flowable washing agent preparation in the washing agent portion unit with one or more further flowable washing agent preparations.

The further washing agent preparation is preferably colored. The colored design of the further washing agent preparation gives a visual indication of the chemical difference between the washing agent preparations combined in the washing agent portion unit and/or of the various performance aspects of the washing agent dosing unit (e.g. cleaning, care or disinfection). The optical differentiation between the washing agent preparations which are contained in the washing agent portion unit and differ from one another can be increased by the first receiving chamber and the second receiving chamber being arranged horizontally one above the other. The second receiving chamber preferably completely covers the first receiving chamber on at least one side of the receiving chamber.

An exemplary washing agent portion unit has at least one further receiving chamber which is surrounded by a water-soluble film and is filled with a third washing agent preparation which differs from the first flowable washing agent preparation and the second washing agent preparation.

A further exemplary washing agent portion unit has at least two further receiving chambers which are surrounded by a water-soluble film and are filled with a third and a fourth washing agent preparation which differ from one another and from the first flowable washing agent preparation and the second washing agent preparation.

In the case of washing agent portion units comprising three or four receiving chambers, the further washing agent preparations are also preferably colored.

It is preferable to shape the water-soluble film in a deep-drawing apparatus and to combine it with the washing agent preparations to form a washing agent portion unit.

The water-soluble film in which the flowable washing agent preparation is packaged can comprise one or more structurally different water-soluble polymer(s). Particularly suitable water-soluble polymer(s) include polymers from the group of (optionally acetalized) polyvinyl alcohols (PVAL) and the copolymers thereof.

Water-soluble films for producing the water-soluble wrapping are preferably based on a polyvinyl alcohol or a polyvinyl alcohol copolymer of which the molecular weight is in the range of from 10,000 to 1,000,000 $gmol^{-1}$, preferably from 20,000 to 500,000 $gmol^{-1}$, particularly preferably from 30,000 to 100,000 $gmol^{-1}$, and in particular from 40,000 to 80,000 $gmol^{-1}$.

The production of polyvinyl alcohol and polyvinyl alcohol copolymers generally includes the hydrolysis of intermediate polyvinyl acetate. Preferred polyvinyl alcohols and polyvinyl alcohols have a degree of hydrolysis of 70 to 100 mol. %, preferably 80 to 90 mol. %, particularly preferably 81 to 89 mol. %, and in particular 82 to 88 mol. %.

Polyvinyl alcohol copolymers which include, in addition to vinyl alcohol, an ethylenically unsaturated carboxylic acid, or the salt or ester thereof, are preferred. Polyvinyl alcohol copolymers of this kind particularly preferably contain, in addition to vinyl alcohol, sulfonic acids such as 2-acrylamido-2-methyl-1-propane sulfonic acid (AMPS), acrylic acid, methacrylic acid, acrylic acid ester, methacrylic acid ester or mixtures thereof; of the esters, $C_{1-4}$ alkyl esters or $C_{1-4}$ hydroxyalkyl esters are preferred. Other suitable monomers are ethylenically unsaturated dicarboxylic acids, for example itaconic acid, maleic acid, fumaric acid and mixtures thereof.

Suitable water-soluble films are sold, for example, by MonoSol LLC under the names M8630, M8720, M8310, C8400 or M8900. Other suitable films include films named Solublon® PT, Solublon® GA, Solublon® KC or Solublon® KL from Aicello Chemical Europe GmbH or the films VF-HP from Kuraray.

The water-soluble films can contain additional active ingredients or fillers, but also plasticizers and/or solvents, in particular water, as further ingredients.

The group of further active ingredients includes, for example, materials which protect the ingredients of the preparation (A) enclosed by the film material from decomposition or deactivation by light irradiation. Antioxidants, UV absorbers and fluorescent dyes have proven to be particularly suitable for this.

Glycerol, ethylene glycol, diethylene glycol, propanediol, 2-methyl-1,3-propanediol, sorbitol or mixtures thereof, for example, can be used as plasticizers.

To reduce its coefficient of friction, the surface of the water-soluble film can optionally be powder-coated with fine powder. Sodium aluminosilicate, silica, talc and amylose are examples of suitable powdering agents.

In order to produce the washing agent portion units, in particular in the context of deep-drawing methods, one embodiment has proven to be advantageous in which the washing agent portion unit comprises three receiving chambers and is sealed by means of a sealing film through which an axis of rotation arranged orthogonally to the sealing film extends.

This application also relates to a method for cleaning textiles, in which a washing agent portion unit according to the invention is introduced into the washing liquor of a textile washing machine.

This application provides the following subjects, inter alia:

1. A washing agent portion unit comprising
   a) at least one first receiving chamber,
   b) at least one water-soluble film surrounding this first receiving chamber, and
   c) at least one first flowable washing agent preparation located in the first receiving chamber, which preparation contains, based on the total weight thereof,
   i) 40 to 80 wt. % surfactant;
   ii) 2 to 15 wt. % fatty acid;
   iii) 0.3 to 8 wt. % of salt of a divalent cation;
   iv) 8 to 35 wt. % solvent;
   d) at least one second receiving chamber which is surrounded by a water-soluble film and is filled with a second washing agent preparation which differs from the first flowable washing agent preparation,
   wherein the first receiving chamber and the second receiving chamber are directly adjacent to one another and separated from one another by a water-soluble film.
2. The washing agent portion unit according to point 1, wherein the first flowable washing agent preparation contains, based on the total weight thereof, 30 to 75 wt. %, preferably 40 to 70 wt. %, of surfactant.
3. The washing agent portion unit according to one of the preceding points, wherein the first flowable washing agent preparation contains, based on the total weight thereof, 20 to 60 wt. %, preferably 25 to 50 wt. %, of anionic surfactant.
4. The washing agent portion unit according to one of the preceding points, wherein at least one anionic surfactant, preferably at least one anionic surfactant from the group consisting of $C_{8-18}$ alkylbenzene sulfonates, $C_{8-18}$ olefin sulfonates, $C_{12-18}$ alkanesulfonates, $C_{8-18}$ ester sulfonates, $C_{8-18}$ alkyl sulfates, $C_{8-18}$ alkenyl sulfates, fatty alcohol ether sulfates, in particular at least one anionic surfactant from the group of $C_{8-18}$ alkyl benzene sulfonates, is contained as the surfactant.

5. The washing agent portion unit according to one of the preceding points, wherein the first flowable washing agent preparation contains, based on the total weight thereof, 4 to 12 wt. %, preferably 6 to 10 wt. %, of fatty acid.

6. The washing agent portion unit according to one of the preceding points, wherein the fatty acid is selected from the group of caprylic acid, capric acid, lauric acid, myristic acid, palmitic acid, stearic acid, oleic acid, linoleic acid and mixtures thereof.

7. The washing agent portion unit according to one of the preceding points, wherein the first flowable washing agent preparation contains, based on the total weight thereof, 0.4 to 6 wt. %, preferably 0.5 to 4 wt. %, of a divalent salt.

8. The washing agent portion unit according to one of the preceding points, wherein the divalent salt is selected from the group of magnesium and calcium salts, preferably from the group of magnesium chloride, magnesium sulfate, calcium chloride and calcium sulfate, in particular from the group of magnesium chloride and calcium chloride.

9. The washing agent portion unit according to one of the preceding points, wherein the first flowable washing agent preparation contains, based on the total weight thereof,
   i) 20 to 80 wt. % surfactant including 20 to 50 wt. % anionic surfactant;
   ii) 4 to 12 wt. % fatty acid;
   iii) 0.5 to 4 wt. % of the salt of a divalent metal cation;
   iv) 8 to 35 wt. % solvent.

10. The washing agent portion unit according to one of the preceding points, wherein the first flowable washing agent preparation contains, based on the total weight thereof, 12 to 32 wt. %, preferably 15 to 30 wt. %, of solvent.

11. The washing agent portion unit according to one of the preceding points, wherein the first flowable washing agent preparation contains, based on the total weight thereof, 7 to 20 wt. %, preferably 10 to 18 wt. %, of organic solvent.

12. The washing agent portion unit according to one of the preceding points, wherein the organic solvent is selected from the group of ethanol, n-propanol, i-propanol, butanols, glycol, propanediol, butanediol, methylpropanediol, glycerol, diglycol, propyl diglycol, butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl ether, propylene glycol ethyl ether, propylene glycol propyl ether, dipropylene glycol mono methyl ether, dipropylene glycol mono ethyl ether, methoxytriglycol, ethoxytriglycol, butoxytriglycol, 1-butoxyethoxy-2-propanol, 3-methyl-3-methoxybutanol, propylene-glycol-t-butylether, di-n-octylether and mixtures thereof, preferably from the group of propanediol, glycerol and mixtures thereof.

13. The washing agent portion unit according to one of the preceding points, wherein the first flowable washing agent preparation contains, based on the total weight thereof, less than 18 wt. %, preferably less than 15 wt. %, of water.

14. The washing agent portion unit according to one of the preceding points, further containing, based on the total weight thereof,
   v) 0.5 to 4 wt. %, preferably 0.5 to 3 wt. % and in particular 0.5 to 2 wt. %, of the salt of a monovalent cation.

15. The washing agent portion unit according to point 14, wherein the salt of a monovalent cation is selected from the group of the salts of monovalent metal cations, preferably from the group of sodium chloride, potassium chloride, sodium sulfate, sodium carbonate, potassium sulfate, potassium carbonate, sodium hydrogen carbonate, potassium hydrogen carbonate, very preferably from the group of sodium chloride.

16. The washing agent portion unit according to one of the preceding points, wherein the first flowable washing agent preparation contains, based on the total weight thereof,
   i) 20 to 80 wt. % surfactant including 20 to 50 wt. % anionic surfactant;
   ii) 4 to 12 wt. % fatty acid;
   iii) 0.5 to 4 wt. % of the salt of a divalent metal cation;
   iv) 8 to 35 wt. % solvent;
   v) 0.5 to 4 wt. % of the salt of a monovalent metal cation.

17. The washing agent portion unit according to one of the preceding points, wherein the first flowable washing agent preparation contains, based on the total weight thereof, 12 to 30 wt. %, preferably 15 to 25 wt. %, of non-ionic surfactant.

18. The washing agent portion unit according to one of the preceding points, wherein at least one non-ionic surfactant from the group of alkoxylated primary $C_{8-18}$ alcohols having a degree of alkoxylation of ≥4, particularly preferably the $C_{12-14}$ alcohols having 4 EO or 7 EO, the $C_{9-11}$ alcohols having 7 EO, the $C_{13-15}$ alcohols having 5 EO, 7 EO or 8 EO, the $C_{13-15}$ oxo alcohols having 7 EO, the $C_{12-18}$ alcohols having 5 EO or 7 EO, the $C_{13-15}$ oxo alcohols having 7 EO, in particular the primary $C_{12-18}$ alcohols having a degree of alkoxylation of ≥4, very particularly preferably the primary $C_{12-18}$ alcohols having 7 EO, is contained as a surfactant.

19. The washing agent portion unit according to one of the preceding points, wherein the first flowable washing agent preparation contains anionic surfactant and non-ionic surfactant in a weight ratio of from 3:1 to 1:2, preferably from 2:1 to 1:1.5 and in particular from 1.4:1 to 1:1.

20. The washing agent portion unit according to one of the preceding points, wherein the first flowable washing agent preparation further contains, based on the total weight thereof,
   vi) 0.3 to 5 wt. % of a co-surfactant selected from the group consisting of alkoxylated primary $C_8$-$C_{18}$ alcohols having a degree of alkoxylation of ≤3, aliphatic $C_6$-$C_{14}$ alcohols, aromatic $C_6$-$C_{14}$ alcohols, aliphatic $C_6$-$C_{12}$ dialcohols, monoglycerides of $C_{12}$-$C_{18}$ fatty acids, monoglycerol ethers of $C_8$-$C_{18}$ fatty alcohols, in particular from the group of alkoxylated primary $C_{12}$-$C_{18}$ alcohols having a degree of alkoxylation of 3.

21. The washing agent portion unit according to one of the preceding points, wherein the first flowable washing agent preparation contains, based on the total weight thereof,
   i) 32.3 to 80 wt. % surfactant including 20 to 50 wt. % anionic surfactant and 12 to 30 wt. % non-ionic surfactant;
   ii) 4 to 12 wt. % fatty acid;
   iii) 0.5 to 4 wt. % of the salt of a divalent cation;
   iv) 8 to 35 wt. % solvent;
   v) 0.3 to 5 wt. % of a co-surfactant that differs from the non-ionic surfactant and is selected from the group consisting of alkoxylated primary $C_8$-$C_{18}$ alcohols having a degree of alkoxylation of ≤3, aliphatic $C_6$-$C_{14}$ alcohols, aromatic $C_6$-$C_{14}$ alcohols, aliphatic $C_6$-$C_{12}$ dialcohols, monoglycerides of $C_{12}$-$C_{18}$ fatty acids, monoglycerol ethers of $C_8$-$C_{18}$ fatty alcohols, in particular from the group of alkoxylated primary $C_{12}$-$C_{18}$ alcohols having a degree of alkoxylation of ≤3.

22. The washing agent portion unit according to one of the preceding points, wherein the first washing agent preparation does not contain any organic opacifying agents, in particular does not contain any styrene-acrylate copolymer.

23. The washing agent portion unit according to one of the preceding points, wherein the first flowable washing agent preparation contains, based on the total weight thereof, less than 2 wt. %, preferably less than 1 wt. %, particularly preferably less than 0.1 wt. % and in particular no enzyme preparation.

24. The washing agent portion unit according to one of the preceding points, wherein the first flowable washing agent preparation contains, based on the total weight thereof, less than 2 wt. %, preferably less than 1 wt. %, particularly preferably less than 0.1 wt. % and in particular no fragrance.

25. The washing agent portion unit according to one of the preceding points, wherein the first flowable washing agent preparation contains, based on the total weight thereof, an optical brightener, preferably a stilbene-type optical brightener, in amounts below 1 wt. %, preferably in amounts below 0.6 wt. %.

26. The washing agent portion unit according to point 25, wherein the optical brightener is selected from the group of triazinyl derivatives of 4,4'-diamino-2,2'-stilbenesulfonic acid, in particular DAS1 (disodium 4,4-bis[(4-anilino-6-morpholino-1,3,5-triazin-2-yl)amino]stilbene-2,2-disulfonate) and DSBP (di sodium 4,4-bis(2-sulfostyryl) biphenyl).

27. The washing agent portion unit according to one of the preceding points, wherein the first flowable washing agent preparation contains, based on the total weight thereof, a blue or violet dye in amounts below 0.1 wt. %, preferably below 0.02 wt. %.

28. The washing agent portion unit according to one of the preceding points, wherein the first flowable washing agent preparation has a viscosity (21° C., Brookfield viscometer type DV-II Pro, spindle no. 2, 20 rpm) above 400 mPas, preferably above 1000 mPas.

29. The washing agent portion unit according to one of the preceding points, wherein the first flowable washing agent preparation has a yield point (TA Instruments rotation rheometer AR 2000, 20° C., cone plate with 40 mm diameter, 2° cone angle) above 0.1 Pa, preferably above 0.3 Pa.

30. The washing agent portion unit according to one of the preceding points, wherein the first flowable washing agent preparation has a turbidity (HACH Turbidimeter 2100Q, 20° C., 10 ml cuvette) above 60 NTU, preferably above 100 NTU and in particular above 400 NTU.

31. The washing agent portion unit according to one of the preceding points, wherein the first flowable washing agent preparation contains lamellar spherulites, preferably having a maximum diameter of from 10 to 100 μm, particularly preferably having a maximum diameter of from 25 to 50 μm.

32. The washing agent portion unit according to one of the preceding points, wherein the second washing agent preparation is colored.

33. The washing agent portion unit according to one of the preceding points, wherein the first receiving chamber and the second receiving chamber are arranged horizontally one above the other.

34. The washing agent portion unit according to one of the preceding points, wherein the second receiving chamber completely covers the first receiving chamber on at least one side of the receiving chamber.

35. The washing agent portion unit according to one of the preceding points, wherein the washing agent has at least one further receiving chamber which is surrounded by a water-soluble film and is filled with a third washing agent preparation which differs from the first flowable washing agent preparation and the second washing agent preparation.

36. The washing agent portion unit according to one of the preceding points, wherein the washing agent has at least two further receiving chambers which are surrounded by a water-soluble film and are filled with a third and a fourth washing agent preparation which differ from one another and from the first flowable washing agent preparation and the second washing agent preparation.

37. The washing agent portion unit according to one of points 35 or 36, wherein the third and fourth washing agent preparations are colored.

38. The washing agent portion unit according to one of the preceding points, wherein the washing agent portion unit comprises three receiving chambers and is sealed by means of a sealing film through which an axis of rotation arranged orthogonally to the sealing film extends.

39. Method for cleaning textiles, in which a washing agent portion unit according to one of the preceding points is introduced into the washing liquor of a textile washing machine.

What is claimed is:

1. A washing agent portion unit comprising at least one first receiving chamber made by a water soluble film;

at least one first flowable washing agent preparation encapsulated in the first receiving chamber, which preparation contains, based on the total weight thereof, i) 20 to 80 wt. % surfactant including anionic surfactant and non-ionic surfactant;

ii) 2 to 15 wt. % fatty acid;

iii) 0.4 to 6 wt. % of a salt of a divalent cation;

iv) 8 to 35 wt. % solvent; and v) 0.3 to 5 wt. % of a co-surfactant that differs from the non-ionic surfactant and is selected from the group consisting of alkoxylated primary $C_8$-$C_{18}$ alcohols having a degree of alkoxylation of ≤3, aliphatic $C_6$-$C_{14}$ alcohols, aromatic $C_6$-$C_{14}$ alcohols, aliphatic $C_6$-$C_{12}$ dialcohols, monoglycerides of $C_{12}$-$C_{18}$ fatty acids, and monoglycerol ethers of $C_8$-$C_{18}$ fatty alcohols, wherein the at least one first flowable washing agent preparation has a turbidity above 60 NTU; and at least one second receiving chamber which is made by a water-soluble film and is filled with a second washing agent preparation which differs from the first flowable washing agent preparation, wherein the first receiving chamber and the second receiving chamber are directly adjacent to one another and separated from one another by at least one water-soluble film.

2. The washing agent portion unit according to claim 1, wherein the first flowable washing agent preparation contains, based on the total weight thereof, 30 to 75 wt. % of the surfactant.

3. The washing agent portion unit according to claim 2, wherein the first flowable washing agent preparation contains, based on the total weight thereof, 40 to 70 wt. % of the surfactant.

4. The washing agent portion unit according to claim 1, wherein the first flowable washing agent preparation contains, based on the total weight thereof, 20 to 60 wt. % of the anionic surfactant.

5. The washing agent portion unit according to claim 4, wherein the first flowable washing agent preparation contains, based on the total weight thereof, 25 to 50 wt. % of the anionic surfactant.

6. The washing agent portion unit according to claim 1, wherein the divalent salt is selected from the group of magnesium and calcium salts.

7. The washing agent portion unit according to claim 6, wherein the divalent salt is selected from the group of magnesium chloride, magnesium sulfate, calcium chloride and calcium sulfate.

8. The washing agent portion unit according to claim 6, wherein the divalent salt is selected from the group of magnesium chloride and calcium chloride.

9. The washing agent portion unit according to claim 1, wherein the first flowable washing agent preparation contains, based on the total weight thereof, i) 20 to 50 wt. % of the anionic surfactant; and ii) 4 to 12 wt. % of the fatty acid.

10. The washing agent portion unit according to claim 1, wherein the first flowable washing agent preparation contains, based on the total weight thereof, i) 20 to 50 wt. % of the anionic surfactant;

ii) 4 to 12 wt. % of the fatty acid; and further comprises iii) 0.5 to 4 wt. % of a salt of a monovalent metal cation.

11. The washing agent portion unit according to claim 1, wherein the first flowable washing agent preparation contains, based on the total weight thereof, i) 32.3 to 80 wt. % of the surfactant including 20 to 50 wt. % of the anionic surfactant and 12 to 30 wt. % of the non-ionic surfactant; and ii) 4 to 12 wt. % of the fatty acid.

12. The washing agent portion unit according to claim 1, wherein the second washing agent preparation is colored.

13. The washing agent portion unit according to claim 1, wherein the first receiving chamber and the second receiving chamber are arranged horizontally one above the other.

14. A method for cleaning textiles, in which a washing agent portion unit according to claim 1 is introduced into the washing liquor of a textile washing machine.

15. The washing agent portion unit according to claim 1, wherein the 0.3 to 5 wt. % of a co-surfactant is selected from the group of alkoxylated primary $C_{12}$-$C_{18}$ alcohols having a degree of alkoxylation of ≤3.

16. A unit dose washing pack comprising:

water-soluble film;

a first chamber made by a water soluble film and comprising a first washing agent preparation; and a second chamber made by a water soluble film that is adjacent to the first chamber and comprising a second washing agent preparation;

wherein the first washing agent preparation has a turbidity above 60 NTU and contains, based on total weight of the first washing agent preparation, 40 to 80 wt. % surfactant including anionic surfactant and non-ionic surfactant;

2 to 15 wt. % fatty acid;

0.4 to 6 wt. % of a salt of a divalent cation;

8 to 35 wt. % solvent; and 0.3 to 5 wt. % of a co-surfactant that differs from the non-ionic surfactant and is selected from the group consisting of alkoxylated primary $C_8$-$C_{18}$ alcohols having a degree of alkoxylation of ≤3, aliphatic $C_6$-$C_{14}$ alcohols, aromatic $C_6$-$C_{14}$ alcohols, aliphatic $C_6$-$C_{12}$ dialcohols, monoglycerides of $C_{12}$-$C_{18}$ fatty acids, and monoglycerol ethers of $C_8$-$C_{18}$ fatty alcohols.

17. The unit dose washing pack of claim 16, wherein the first washing agent preparation contains about 0.5 to 4 wt. % of the salt of a divalent cation.

18. The unit dose washing pack of claim 16, wherein the first washing agent preparation has a turbidity above 100 NTU.

19. A unit dose washing pack comprising:

water-soluble film;

a first chamber made by a water soluble film and comprising a first washing agent preparation; and a second chamber made by a water soluble film that is adjacent to the first chamber and comprising a second washing agent preparation;

wherein the first washing agent preparation has a turbidity above 100 NTU and contains, based on total weight of the first washing agent preparation, 20 to 80 wt. % surfactant;

2 to 15 wt. % fatty acid;

0.5 to 4 wt. % of a salt of a divalent cation;

0.5 to 4 wt. % of a salt of a monovalent metal cation;

8 to 35 wt. % solvent; and 0.3 to 5 wt. % of a co-surfactant that differs from the non-ionic surfactant and is selected from the group consisting of alkoxylated primary $C_8$-$C_{18}$ alcohols having a degree of alkoxylation of ≤3, aliphatic $C_6$-$C_{14}$ alcohols, aromatic $C_6$-$C_{14}$ alcohols, aliphatic $C_6$-$C_{12}$ dialcohols, monoglycerides of $C_{12}$-Cis fatty acids, and monoglycerol ethers of $C_8$-$C_{18}$ fatty alcohols.

20. The unit dose washing pack of claim 19, wherein the first washing agent preparation has a turbidity above 400 NTU.

* * * * *